United States Patent [19]

Rosen

[11] 4,424,163

[45] Jan. 3, 1984

[54] SELECTIVE REDUCTION OF EDIBLE FATS AND OILS

[75] Inventor: Bruce I. Rosen, Skokie, Ill.

[73] Assignee: UOP Inc., Des Plaines, Ill.

[21] Appl. No.: 338,736

[22] Filed: Jan. 11, 1982

[51] Int. Cl.[3] ..... C11C 3/12

[52] U.S. Cl. ..... 260/409; 502/337

[58] Field of Search ..... 260/409; 252/472

[56] References Cited

U.S. PATENT DOCUMENTS

| | | | |
|---|---|---|---|
| 2,656,371 | 10/1953 | Baldwin et al. | 260/409 |
| 3,443,967 | 5/1969 | Teasdale | 260/409 X |
| 3,498,927 | 3/1970 | Stiles | 252/472 X |
| 3,969,382 | 7/1976 | Zosel | 260/409 |
| 4,149,998 | 4/1979 | Tauster et al. | 252/473 |
| 4,161,483 | 7/1979 | Cahen | 260/409 |
| 4,188,333 | 2/1980 | Cahen | 260/409 |
| 4,206,134 | 6/1980 | Kugler et al. | 252/473 X |
| 4,206,135 | 6/1980 | Kugler et al. | 260/449.6 R |
| 4,229,361 | 10/1980 | Cahen | 260/409 |
| 4,317,748 | 3/1982 | Torok et al. | 252/472 |

OTHER PUBLICATIONS

Chemical Abstracts 63 8623d (1965).
Chemical Abstracts 63 8623f (1965).
J. A. Horsely, *Science, 211* pp. 1121–1125 (1981).

*Primary Examiner*—Helen M. S. Sneed
*Attorney, Agent, or Firm*—James R. Hoatson, Jr.; Eugene I. Snyder; William H. Page, II

[57] ABSTRACT

Selective reductions of fatty materials occur using a catalyst consisting of essentially of zerovalent nickel dispersed on a support which shows strong metal, support interaction. A particularly desirable catalyst is one where the nickel is dispersed on titania which is subsequently activated in hydrogen at a temperature above about 325° C. The catalyst is sufficiently selective so as to permit continuous reduction of fatty material using a fixed bed of catalyst.

10 Claims, No Drawings

SELECTIVE REDUCTION OF EDIBLE FATS AND OILS

BACKGROUND OF THE INVENTION

Although some edible oils are used per se, by far the largest portion are hydrogenated, or hardened, prior to their end use. The reason for such hydrogenation is to increase the stability of the final product. For example, processed soybean oil is susceptible to oxidation resulting in deterioration of its organoleptic properties upon storage even at ambient temperature. Where the oil is to be used at higher temperatures, for example, as a frying oil, the adverse organoleptic consequences of oxidation become even more pronounced.

The commonly accepted origin of oxidative deterioration is the presence of highly unsaturated components, such as the triene moiety, linolenate, in soybean oil. Partial hydrogenation to remove most of this component leads to a marked increase in the oxidative stability of the resulting product, thereby facilitating storage and permitting unobjectionable use at higher temperatures. Ideally, one desires this hydrogenation to be highly specific, reducing only triene to the diene, linoleate, without effecting cis to trans isomerization. In practice, this goal is unachievable.

The edible fats and oils which are the subject of this invention are triglycerides of fatty acids, some of which are saturated and some of which are unsaturated. In vegetable oils, the major saturated fatty acids are lauric (12:0), myristic (14:0), palmitic (16:0), stearic (18:0), arachidic (20:0), and behenic (22:0) acids. The notation, "18:0," for example, means an unbranched fatty acid containing 18 carbon atoms and 0 double bonds. The major unsaturated fatty acids of vegetable oils may be classified as monounsaturated, chief of which are oleic (18:1) and erucic (22:1) acids, and polyunsaturated, chief of which are the diene linoleic acid (18:2), and the triene linolenic acid (18:3). Unhardened vegetable fats and oils contain virtually exclusively cis-unsaturated acids.

In the context of partial hydrogenation, the ultimate goal is the reduction of triene to diene without attendant trans-acid formation or saturate formation. In practice, it is observed that partial reduction results in lowering both triene and diene and increasing the monoene, saturate, and trans levels. Because it is desired that the product of partial hydrogenation itself be a liquid oil relatively free of sediment or even cloudiness upon storage at, for example, 10° C., the formation of saturated and trans acids in such hydrogenation is a vexing problem. Removal of these solids, whose relative amount is measured by the Solid Fat Index (SFI), is a relatively costly and inefficient process attended by large losses associated with the separation of gelatinous solids from a viscous liquid. It is known in the art that such solids are composed largely of triglycerides containing at least one saturated fatty acid moiety and/or trans monounsaturated fatty acid moiety with the predominant culprits having at least 18 carbon atoms. It is further known in the art that fatty acid analysis alone is an insensitive analytical tool, that is to say, two products of hydrogenation of, for example, soybean oil may be vastly different in their SFI while having virtually identical fatty acid analysis. This arises because the distribution of the saturated moieties in the triglyceride is important. The solubility in the soybean oil of disaturated triglycerides is much less than twice the amount of monosaturated triglycerides, and the solubility of monosaturated triglycerides may depend upon whether the other fatty acid moieties of the triglyceride are monounsaturated, diunsaturated, etc., and may also depend upon whether the saturated portion is at the one- or two- position of the triglyceride. Hence, hydrogenation of edible fats and oils is largely an empirical process, whose analytical tools include SFI supported by fatty acid analysis. The difficulty of achieving desirable results, in the context of selectivity in Solid Fat Index, has largely limited such hydrogenation to a batch type process. Although the transition from a batch to a continuous process, especially of the fixed bed type, is conceptually facile, it will be recognized by the skilled worker that impediments have been substantial.

In the context of this application, a method of hydrogenation of edible oils is selective if it is capable of reducing the iodine value of soybean oil from about 10 to about 30 units with a concomitant increase in saturates of less than about 1.5% and a decrease in triene level to at least 3%. The Solid Fat Index of such a selectively hydrogenated product is preferably less than about 5 at 50° F., less than about 2 at 70° F., less than 1 at 80° F., and 0 at 90° F.

It must be clearly recognized and understood that although this definition of selective hydrogenation utilizes a specific decrease in iodine value of a particular edible oil, a selective hydrogenation may cause a greater decrease in iodine value and/or be effected with a different edible oil. That is to say, the definition of selective hydrogenation does not restrict a selective hydrogenation to the conditions of its definition.

Although catalyst supports generally have been viewed as passive agents for carrying catalysts, such as zerovalent metals, in a highly dispersed state, there recently has developed a body of knowledge, both theoretical and experimental, showing strong metal-support interaction (SMSI) in a class of metal oxides bearing zerovalent metals. S. J. Tauster, S. C. Fung, R. T. K. Baker, and J. A. Horsley, *Science,* 211, 1121 (1981). Catalysts exhibiting such SMSI have been prepared in U.S. Pat. No. 4,149,998. The expectation that SMSI would significantly alter the catalytic properties of a dispersed metal, even though the alteration may be unpredictable, has also been experimentally confirmed, largely in the case of Fischer-Tropsch catalysts as shown in U.S. Pat. Nos. 4,206,134 and 4,206,135.

I have found that zerovalent nickel dispersed on supports manifesting SMSI shows surprisingly increased selectivity in the reduction of edible oils and fats. This observation forms the basis for the invention described herein, which is a method for selectively hydrogenating fats and oils by either a batch or continuous process. The utility and importance of this invention is readily discerned when it is appreciated that commercial methods of continuous reductions of fatty materials are at once highly desirable and extraordinarily difficult, with no general method presently available for widespread industrial usage.

U.S. Pat. No. 4,188,333 describes a method of selectively hydrogenating vegetable oils in a batch process using a nickel on titanium oxide carrier as catalyst. The role of the carrier there is simply a geometrical one, non-chemical in nature, whereas in the catalysts employed in the process which is the invention herein, the carrier exhibits a strong chemical interaction with the metallic phase. This contrast between a passive, geometric role for certain oxides as carriers or supports for zerovalent metals and a strong chemical interaction between the support and metal (SMSI) has been adequately discussed in U.S. Pat. No. 4,149,998. It suffices to say that an essential element of this invention is the use of a nickel catalyst exhibiting SMSI properties.

SUMMARY OF THE INVENTION

The object of this invention is to provide a method of selective reduction of fatty materials. An embodiment of the invention is the reduction utilizing a catalyst which consists essentially of zerovalent nickel dispersed on a support under conditions leading to strong metal-support interaction. A catalyst consists essentially of nickel on titanium dioxide activated in hydrogen at a temperature between about 325° and 600° C. In a still more specific embodiment activation is performed at a temperature between about 350° and 550° C. Other objects and embodiments appear within.

DESCRIPTION OF THE INVENTION

The invention described herein is based on my discovery that a catalyst consisting essentially of zerovalent nickel dispersed on a metal oxide under conditions where there is a strong metal-support interaction displays superior selectivity in the hydrogenation of fatty materials. The process which is my invention is a method of selectively reducing fatty materials where the selectivity is sufficiently great so as to permit a continuous hydrogenation process using a fixed catalyst bed. Briefly, the invention described within is a method for the selective reduction of a fatty material comprising contacting under hydrogenation conditions the fatty material with hydrogen and a catalyst which consists essentially of zerovalent nickel dispersed on a support selected from the group consisting of $TiO_2$, $Ta_2O_5$, $V_2O_5$ and $Nb_2O_5$, the catalyst having been activated in hydrogen at a temperature from about 325° to about 600° C., and recovering the selectively reduced product.

One index of selectivity as used herein is the Solid Fat Index, as described above. Another index of selectivity relied upon here and commonly used elsewhere can be better understood from the following partial reaction sequence, where k is the rate constant for the indicated hydrogenation step.

$$18{:}3 \xrightarrow{k_3} 18{:}2$$

$$18{:}2 \xrightarrow{k_2} 18{:}1$$

$$18{:}1 \xrightarrow{k_1} 18{:}0$$

$$^{S}LN = k_3/K_2$$

$$^{S}LO = k_2/k_1$$

$^{S}$LN is termed the linolenate selectivity; a high value is characterized by relatively high yields of dienoic acid in the reduction of an unsaturated triglyceride containing trienoic acids. $^{S}$LO is the linoleate selectivity; a high value is characterized by relatively high yields of monoenoic acid in a reduction of an unsaturated triglyceride containing dienoic acids. An oil such as soybean oil contains both trienoic and dienoic acids, thus $^{S}$LN and $^{S}$LO may be measured simultaneously.

The catalyst used in the process of this invention affords hydrogenated products with substantially improved SFI profiles and shows substantially increased values of $^{S}$LN and $^{S}$LO relative to the nickel catalysts of the prior art, with values of $^{S}$LO being fairly characterized as outstanding.

The method described herein is generally applicable to edible oils and fats of vegetable and animal origin, collectively referred to herein as fatty materials. Because the partial hydrogenation of liquid oils to afford hardened, but still liquid, oils occupies a prominent part within the domain of hydrogenation of edible oils and fats, the method of this invention is particularly applicable to such partial hydrogenation. Thus, the described method of hydrogenation is especially useful to partially harden edible liquid oils whereby the iodine value (IV) is lowered from about 10 to about 30 units by hydrogenation, whereby the increase in saturates attending hydrogenation is less than about 1.5%, and where the triene level is reduced to at least 3%. It is preferred that such a partially hydrogenated product have an SFI of less than about 5 at 50° F., less than about 2 at about 70° F., less than 1.0 at 80° F., and 0 at 92° F. The term "iodine value" is a measure of the total extent of unsaturation in an edible oil or fat as performed by a standard test. In the context of soybean oil, which is a particularly important liquid vegetable oil, partial hardening is continued to an IV drop of from about 15 to about 25 units, with the product having less than about 6% stearate and less than about 3% linolenate.

Although the method claimed herein is especially valuable when applied to the partial hydrogenation of liquid vegetable oils, it must be explicitly recognized that the selectivity of the claimed method is also manifested in more extensive hydrogenations. Thus, as is shown below, the claimed method may be used generally in hydrogenating edible oils whenever selective hydrogenation is desired.

The method of this invention is especially applicable to liquid vegetable oils. Examples of such oils include soybean oil, cottonseed oil, sunflower oil, safflower oil, rapeseed oil, and liquid fractions from palm oil. The application of this method to soybean oil is especially important. As will be recognized by those skilled in the art, partial hydrogenation of liquid oils to afford partially hardened liquid oils is especially demanding, hence it is to be expected that a method suitable for this task also is suitable for more extensive hydrogenation. Thus, the method described herein also is suitable for more extensive hydrogenation, where the change in IV is from about 30 to about 70 units. Oils and fats which can be so hydrogenated include those above, their partially hydrogenated products, and also such feedstocks as palm oil.

The catalyst used in this invention is zerovalent nickel dispersed on a metal oxide under conditions where there is a strong metal-support interaction. Although the percentage of nickel on support is not critical, the nickel generally will be present in the range from about 1 to about 40 wt.% of support, with a range from about 5 to about 25 percent being the more usual one. Since catalyst life is somewhat related to nickel loading, it is desirable to have as high loading as possible consistent with catalyst selectivity. Nickel loading under about 5% is therefore generally undesired for practical considerations of catalyst life.

The metal oxides which serve as the support in this invention include titanium dioxide, $TiO_2$, tantalum pentoxide, $Ta_52_5$, vanadium pentoxide, $V_2O_5$, and niobium pentoxide, $Nb_2O_5$, with titanium dioxide being preferred. The catalyst of this invention typically is prepared by impregnating the oxide with a suitable nickel salt, reducing the nickel to its zerovalent state, and activating the catalyst in hydrogen at a temperature from about 325° to about 600° C.

The aforementioned oxides are impregnated with a suitable nickel salt, generally by mixing an aqueous solution of a nickel salt, such as nickel chloride or nickel nitrate, with the oxide and removing water by evaporation. Alternately, impregnation may be achieved by precipitation of an insoluble nickel salt, such as nickel hydroxide, in the presence of a suitable oxide. Where the nickel salt is not readily reduced to zerovalent nickel, as for example nickel nitrate, the impregnated oxide may be first calcined to form a reducible precursor, as nickel oxide.

The nickel is then reduced to its zerovalent state, generally by treatment of the nickel salt-impregnated oxide in a hydrogen stream at an elevated temperature. To produce the catalysts of this invention, viz., those exhibiting SMSI, it is necessary to activate the catalyst in hydrogen at a temperature from about 325° C. to about 600° C., more preferably at a temperature from about 350° C. to about 550° C. Reduction and hydrogen activation may be combined, as by treating a reducible nickel salt with hydrogen at about 325° C. to about 600° C. In suitable cases calcination, reduction, and hydrogen activation may be combined.

The necessity for hydrogen activation to confer SMSI properties on a particular metal-support composite has been taught in U.S. Pat. No. 4,149,998. It is to be clearly understood that if hydrogenation activation is not practiced a different catalyst—one not exhibiting the desired SMSI properties—will be formed which will fail to exhibit the selectivity characteristics of the invention claimed herein.

Hydrogenation conditions embrace a temperature from about 150° to about 300° C. at a hydrogen pressure from atmospheric up to about 200 psig. Because the selectivity of hydrogenation seems to increase with increasing temperature and decreasing pressure, there is some advantage to operating at the highest possible temperature and lowest possible pressure consistent with an acceptable reaction rate. Operationally, a temperature range from about 150° to about 250° C. is preferred. The preferred range of pressure is from about 5 to about 150 psig, with a range from about 5 to about 50 psig being still more preferred.

The method of this invention is equally applicable to a batch or continuous process. In a batch process, the fatty material to be hydrogenated is mixed with an effective amount of nickel catalyst, and the mixture brought to the desired temperature, which is preferably from about 150° to about 250° C. The mixture is then vigorously agitated under hydrogen pressure, preferably from about 25 to about 150 psig, for a time sufficient to effect the desired degree of hydrogenation, at which time agitation is stopped and catalyst is removed, as by filtration. Hydrogenation time or duration, which depends upon the extent of hydrogenation desired, the oil used, the catalyst concentration, and hydrogenation temperature and pressure, may be from about 0.5 hr. up to about 10 hr. The resulting hydrogenated fatty material is then recovered for subsequent processing.

The following description is applicable to a fixed bed operation, although it will be recognized that by suitable changes it may also be applicable to expanded or fluidized bed operation. The catalyst bed may be in the form of pellets, granules, spheres, extrudate, and so forth. The reactor is heated to the desired reaction temperature in a hydrogen atmosphere, often with a small hydrogen flow. After attainment of the desired temperature, the feedstock consisting of fatty material is made to flow over the fixed bed. The flow may be either downflow, as in a trickle bed operation, or upflow, as in a flooded bed operation. The flow rate of the oil may be from about 0.5 to about 20 LHSV, with rates from about 1 to about 5 being more common. When the flow of edible fats and oils is initiated, it is desirable to mix the hydrogen with said fats and oils so as to maintain the desired pressure. Often it is advantageous to admit excess hydrogen, maintaining pressure by partial venting. As the reaction proceeds and the activity of the catalyst bed decreases, adjustments may be made either in the LHSV or the temperature to maintain the desired characteristics of the product. Partially hardened oil is recovered as the effluent in a state suitable for further processing, such as blending, bleaching, or deodorization.

The examples given below are for illustrative purposes only, and are not to be construed as limiting this invention in any way.

EXAMPLE 1

The various catalysts used in the reduction of fatty materials were prepared in the following way. To 100 g of titanium dioxide was added 150 ml deionized water and 25 g $Ni(NO_3)_2.6H_2O$ which had been dissolved in 75 ml of deionized water. The volatiles were subsequently removed by evaporation with steam over a period of about 3 hours.

Catalyst A was calcined in air at 500° C. for 2 hours and then reduced and activated in a stream of hydrogen at 500° C. for 3 hours. The crystallite size was about 124 Angstroms. Catalyst B was calcined in air at 200° C. for 2 hours then reduced with hydrogen at 200° C. for 3 hours. The crystallite size was about 100 Angstroms. The following tables show the properties of the titania used in the preparation of these catalysts.

TABLE 1

Physical Properties of $TiO_2$

| | |
|---|---|
| Surface area | 130 $m^2/g$ |
| Micropore volume (pores under 117A) | 0.3 ml/g |
| Macropore volume (pores larger than 117A) | 0.44 ml/g (ANSI/ASTM D2873-10) |

| Diameter range, in Angstroms | Volume in range, ml/g | % volume in range |
|---|---|---|
| 117–200 | .1339 | 30.61 |
| 200–300 | .0764 | 17.46 |
| 300–500 | .1128 | 25.78 |
| 500–1,000 | .0983 | 22.47 |
| 1,000–1,750 | .0134 | 3.06 |
| 1,750–3,500 | .0016 | 0.37 |
| 3,500–17,500 | .0011 | 0.25 |
| 17,500–58,333 | .0000 | 0 |

EXAMPLE 2

The catalysts used were 5% nickel on titania (as 1/16 inch spheres) prepared according to the method described in Example 1 and reduced and activated in hydrogen at temperatures between 200° and 500° C. In the table below the catalyst is identified by its activation temperature. Reduction was performed at 210°–215° C. at a hydrogen pressure of 50 psig using 55 ml soybean oil and 2 g of catalyst.

TABLE 2

Batch Reduction of Soybean Oil

| Catalyst, activation °C. | time minutes | Composition, %[a] 18:3 | 18:2 | 18:1 | 18:0 | 16:0 | IV (calc) | $S_{LN}$[b] | $S_{LO}$[b] |
|---|---|---|---|---|---|---|---|---|---|
| 500 | 90 | −(0.1) | 32.1 (32.0) | 53.0 (52.9) | 4.7 | 10.2 | 101.1 | 6.4 | 141.5 |
| 400 | 60 | −(0.1) | 31.0 (30.8) | 54.4 (54.1) | 4.8 | 9.8 | 100.4 | 6.1 | 151.4 |
| 300 | 50 | 0.2 | 19.9 | 64.6 | 5.2 | 10.1 | 90.5 | 3.1 | 114.7 |
| 200 | 45 | 3.5 | 39.8 | 41.5 | 5.2 | 10.0 | 113.7 | 1.9 | 32.7 |

[a]Values in parenthesis were those used in calculating $S_{LN}$, $S_{LO}$. For the first two entries total saturates (16:0 + 18:0) of 15.0 were used as input.
[b]Calculated using a computer program furnished by the U.S. Department of Agriculture, Northern Regional Laboratories, as described in J. Amer. Oil Chemists Soc., 56, 664 (1979).

The table clearly shows the extraordinarily high selectivity of the first two catalysts and the substantial decline in selectivity when activation in hydrogen is performed at a temperature of 300° C. or less. Not unexpectedly, the table also shows an inverse relationship between selectivity and reactivity as measured by reaction time.

EXAMPLE 3

Continuous hydrogenations were conducted in a reactor of conventional design containing a fixed bed of about 50 ml catalyst in the form of an extrudate less than about 1/16 inch in diameter. The reactor had a preheater section for bringing feedstock to temperature and a heater for the reaction zone. The feedstock, which was soybean oil in these samples, was passed upflow by a metering pump and mixed with hydrogen before the preheater stage. In all cases there was a net excess of hydrogen, that is, hydrogen in excess of that necessary for reaction was introduced into the reaction zone and excess hydrogen was vented so as to maintain a constant pressure. Catalysts A and B are those described in Example 1.

Iodine values were determined by AOCS method CD1-25 or were calculated from the measured fatty acid distribution. Solid fat index was determined by AOCS method CD10-57. Fatty acid distribution was determined by AOCS method CE2-66. A typical analysis of soybean oil in this and the preceding example is 7.4% 18:3, 54% 18:2, 24% 18:1, 4.5% 18:0, and 10.2% 16:0.

TABLE 3

Continuous Reduction of Soybean Oil

| LHSV | $H_2$ flow (SCF/hr) | T (°C.) | Press | 18:3 | 18:2 | 18:1 | 18:0 | 16:0 | IV (calc) | $S_{LN}$ | $S_{LO}$ | % trans |
|---|---|---|---|---|---|---|---|---|---|---|---|---|
| | | | | | | Catalyst A | | | | | | |
| 3 | 0.4 | 195 | 50 | 3.4 | 41.9 | 39.7 | 4.5 | 10.4 | 115.6 | 2.28 | 50.85 | 31.3 |
| 0.6 | 0.1 | 195 | 50 | 0.9 | 14.8 | 66.8 | 6.8 | 10.7 | 85.4 | 1.41 | 27.81 | 48.3 |
| 0.6 | 0.4 | 195 | 50 | — | 11.9 | 67.0 | 10.7 | 10.5 | 78.2 | 2.51 | 13.87 | 48.5 |
| 3 | 0.4 | 195 | 50 | 4.4 | 44.7 | 36.2 | 4.7 | 10.2 | 119.8 | 2.02 | 45.55 | 22.4 |
| 3 | 0.4 | 195 | 100 | 4.8 | 45.1 | 34.5 | 5.5 | 10.2 | 120.3 | 1.80 | 7.77 | 21.2 |
| 3 | 0.4 | 195 | 25 | 6.6 | 49.6 | 29.4 | 4.5 | 10.0 | 128.3 | 1.21 | 15.88 | 13.8 |
| 3 | 0.4 | 195 | 50 | 6.3 | 49.0 | 30.0 | 5.0 | 9.9 | 126.9 | 1.35 | 19.85 | 13.1 |
| 3 | 0.4 | 210 | 50 | 6.2 | 47.1 | 31.9 | 5.1 | 9.8 | 125.1 | 1.19 | 16.26 | 16.9 |
| 3 | 0.4 | 225 | 50 | 4.9 | 42.4 | 37.6 | 5.0 | 10.2 | 118.5 | 1.36 | 23.81 | 24.3 |
| 3 | 0.4 | 195 | 50 | 6.0 | 46.6 | 32.6 | 4.7 | 10.2 | 124.1 | | | 15.6 |
| | | | | | | Catalyst B | | | | | | |
| 3 | 0.4 | 195 | 50 | 4.5 | 43.0 | 36.4 | 5.8 | 10.2 | 117.6 | 1.69 | 7.18 | 21.7 |
| 0.6 | 0.1 | 195 | 50 | 1.1 | 21.9 | 52.7 | 13.8 | 10.4 | 86.2 | 1.78 | 4.70 | 34.5 |
| 0.6 | 0.4 | 195 | 50 | 1.0 | 17.1 | 54.1 | 17.7 | 10.2 | 78.6 | 1.49 | 4.46 | 37.1 |
| 3 | 0.4 | 195 | 50 | 4.5 | 44.1 | 35.8 | 5.6 | 10.1 | 118.7 | 1.85 | 8.93 | 24.7 |
| 3 | 0.4 | 195 | 100 | 3.9 | 39.3 | 37.8 | 8.8 | 10.2 | 110.8 | 1.60 | 2.94 | 23.7 |
| 3 | 0.4 | 195 | 25 | 5.4 | 47.2 | 32.3 | 5.1 | 10.2 | 123.5 | 1.72 | 10.60 | 18.0 |
| 3 | 0.4 | 195 | 50 | 4.7 | 46.3 | 33.0 | 5.7 | 10.4 | 120.8 | 2.12 | 4.64 | 17.3 |

TABLE 4

Solid Fat Index - Continuous Reduction

| | | Catalyst A | Catalyst B |
|---|---|---|---|
| IV, | found | 87.6 | 82.8 |
| | calc | 81.6 | 82.3 |
| SFI, at | 50° F. | 37.7 | 33.4 |
| | 70° F. | 25.2 | 30.2 |
| | 80° F. | 16.9 | 28.4 |
| | 92° F. | 4.6 | 21.6 |
| | 104° F. | 0 | 15.9 |

The data show that the product obtained using catalyst calcined at 500° C. shows a steeper SFI slope, akin to that of confectionary fats, than that obtained from catalyst calcined at a lower temperature. The feature of a steeper SFI slope is characteristic of products prepared using catalyst A and generally the steeper the slope the more selective the hydrogenation.

What is claimed is:

1. A method for the selective reduction of a fatty material comprising contacting under hydrogenation conditions the fatty material with hydrogen and a catalyst which consists essentially of a minor amount from about 1 to about 40 weight percent zerovalent nickel dispersed on a support selected from the group consisting of $TiO_2$, $Ta_2O_5$, $V_2O_5$, and $Nb_2O_5$, said catalyst having been activated in hydrogen at a temperature from about 325° to about 600° C., and recovering the selectively reduced product.

2. The method of claim 1 where the fatty material is a liquid vegetable oil.

3. The method of claim 2 where the liquid vegetable oil is selected from the group consisting of soybean oil, cottonseed oil, sunflower oil, safflower oil, rapeseed oil, and liquid fractions from palm oil.

4. The method of claim 3 where the oil is soybean oil and contacting is of a duration sufficient to lower its iodine value from about 15 to about 25 units.

5. The method of claim 1 where the support is $TiO_2$.

6. The method of claim 1 where the catalyst is activated at a temperature from about 350° to about 550° C.

7. The method of claim 1 where hydrogenation conditions embrace a hydrogen pressure from atmospheric to about 200 psig and a temperature from about 150° to about 300° C.

8. The method of claim 7 where the pressure is from about 5 to about 150 psig.

9. The method of claim 8 where the pressure if from about 5 to about 50 psig.

10. The method of claim 7 where the temperature is from about 150° to about 250° C.

* * * * *